US011246456B2

(12) United States Patent
Davis et al.

(10) Patent No.: US 11,246,456 B2
(45) Date of Patent: Feb. 15, 2022

(54) SHOWER GRIPPING ACCESSORY DEVICE

(71) Applicants: Kelly Jo Davis, Pearland, TX (US); Ronald Davis, Pearland, TX (US)

(72) Inventors: Kelly Jo Davis, Pearland, TX (US); Ronald Davis, Pearland, TX (US)

( * ) Notice: Subject to any disclaimer, the term of this patent is extended or adjusted under 35 U.S.C. 154(b) by 0 days.

(21) Appl. No.: 16/855,467

(22) Filed: Apr. 22, 2020

(65) Prior Publication Data

US 2021/0212523 A1 Jul. 15, 2021

Related U.S. Application Data

(60) Provisional application No. 62/961,211, filed on Jan. 15, 2020.

(51) Int. Cl.
*A47K 3/28* (2006.01)

(52) U.S. Cl.
CPC ..... *A47K 3/281* (2013.01)

(58) Field of Classification Search
CPC ..... A47K 3/281; A47K 17/022; A47K 17/024
See application file for complete search history.

(56) References Cited

U.S. PATENT DOCUMENTS 3,310,447 A * 3/1967 Matthews ..... F16L 11/085 156/244.13
5,702,799 A * 12/1997 Brown ..... B32B 5/16 428/143
7,963,857 B1 * 6/2011 Kachlik ..... A63B 53/14 473/300
9,795,260 B2 * 10/2017 Castellini ..... A47K 17/024
2008/0087371 A1 * 4/2008 Friedrich ..... B29C 70/205 156/166
2010/0112249 A1 * 5/2010 Boyce ..... B29C 70/12 428/34.5
2014/0134358 A1 * 5/2014 Hart ..... E04F 11/1808 428/34.1
2016/0025271 A1 * 1/2016 Linge ..... A47K 3/003 362/253
2016/0157680 A1 * 6/2016 Gucciardo ..... A47K 3/003 52/27
2016/0166118 A1 * 6/2016 McDonald ..... A47K 3/003 4/611
2018/0028022 A1 * 2/2018 Scott ..... A47K 3/281
2018/0178097 A1 * 6/2018 Goji ..... A63B 53/14
2020/0102753 A1 * 4/2020 Holland ..... E04F 11/1802
2021/0196084 A1 * 7/2021 Bice ..... F21V 33/004

* cited by examiner

*Primary Examiner* — J C Jacyna

(57) ABSTRACT

A shower gripping accessory device is provided which may comprise an elongate cylindrical body having a plurality of terminal ends. The elongate cylindrical body may comprise an outer shell body and a cavity therein. The thickness value of the outer shell body may be substantially between one-quarter to one-half a radius value of the cavity. Further, a multilayered frictional surface substrate may be disposed over the outer shell body. The multilayered frictional surface substrate may comprise a flexible polymer base layer, one or more adhesive resin layers and a frictional material layer. The one or more adhesive resin layers may couple the frictional material layer to the flexible polymer base layer.

20 Claims, 2 Drawing Sheets

SHOWER GRIPPING ACCESSORY DEVICE

CROSS-REFERENCE TO RELATED APPLICATIONS

This application claims priority to U.S. Provisional Patent Application Ser. No. 62/961,211, entitled "SHOWER GRIPPING ACCESSORY DEVICE," filed Jan. 15, 2020. The contents of this application are hereby incorporated by reference in their entirety.

BACKGROUND OF THE INVENTION

Personal injury caused by loss of stability when traversing various indoor and outdoor environments continues to be a problem for both the individual and also business hosting such individuals as customers. For the individuals, the inability to maintain stability in any environment can lead to significant personal injury or even death. For example, a swift decline in the health of senior citizens is often precipitated by an injurious fall that physically limits their mobility. Additionally, when individuals of any age sustain an injurious fall when on the premises of a third-party business, liability may be incurred by the third-party business for the injuries sustained by the individual. Such liability may lead to financial loss for the business to the extent that the business is forced to cease operations. Therefore, there is a need for cost-effective solutions to prevent physical and financial injury not only to individuals but also for any third-party business.

Given the need for a means to prevent injurious falls due to lack of stability when traversing various environments, it would be advantageous to provide a gripping device that helps to prevent individuals from completely losing stability when in proximity to such a gripping device. Further, it would be advantageous to provide a gripping device that has a form factor that optimizes the coefficient of friction with the human hand in order to maximize the ability for the individual to stabilize themselves before suffering an injurious fall. Additionally, it would be advantageous to provide a gripping device that comprises exterior surface structures that optimize the coefficient of friction with the human hand in order to maximize the ability for the individual to stabilize themselves before suffering an injurious fall. Moreover, it would be advantageous to provide a gripping device comprising one or more illumination elements to allow the individual to visually locate the gripping device when traversing a poorly lit environment. Further, it would be advantageous to provide a gripping device that allows for periodic replacement of exterior surface structures to ensure that iterative use and/or exposure to environmental elements does not compromise the structural integrity and/or overall effectiveness of the gripping device without cost-effective recourse for resolving such problems.

DETAILED DESCRIPTION OF THE INVENTION

Figure 1:
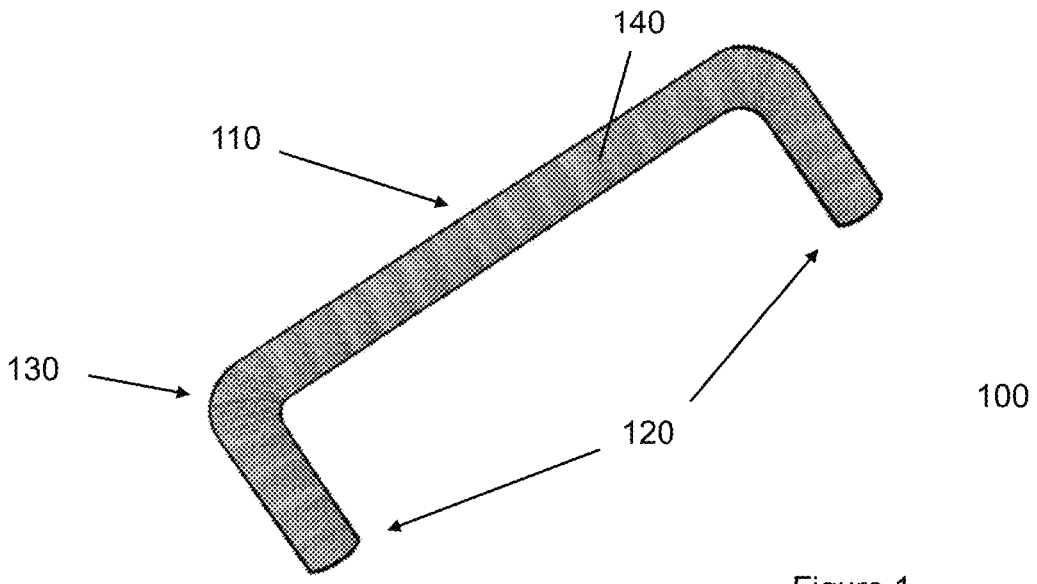
FIG. 1 is a perspective view of a shower gripping accessory device in accordance with some embodiments of the present invention.

Before describing the present invention in detail, it is to be understood that the invention is not limited to any one of the particular embodiments, which of course may vary. It is also to be understood that the terminology used herein is for the purpose of describing particular embodiments only, and therefore is not necessarily intended to be limiting. As used in this specification and the appended claims, terms in the singular and the singular forms "a," "an," and "the" include plural referents unless the context clearly dictates otherwise. Thus, for example, reference to "a shower gripping accessory device" also includes a shower gripping accessory devices, and the like.

In some embodiments, a shower gripping accessory device is provided comprising an elongate cylindrical body having a plurality of terminal ends, wherein the elongate cylindrical body comprises an outer shell body and a cavity therein, and wherein a thickness value of the outer shell body is substantially between one-quarter to one-half a radius value of the cavity; and a multilayered frictional surface substrate disposed over the outer shell body, wherein the multilayered frictional surface substrate comprises a flexible polymer base layer, one or more adhesive resin layers and a frictional material layer, and wherein the one or more adhesive resin layers couple the frictional material layer to the flexible polymer base layer.

In some embodiments, the elongate cylindrical body comprises one or more areas of structural curvature.

In some embodiments, the elongate cylindrical body and the plurality of terminal ends are disposed along a first common axis.

In some embodiments, the elongate cylindrical body comprises one or more elongate portions arranged substantially perpendicular to the elongate cylindrical body at one or more structural junctions thereof, wherein the one or more structural junctions are not disposed adjacent any one of the plurality of terminal ends.

In some embodiments, the flexible polymer base layer comprises one or more materials selected from PET, PE, PVC, PP, PS, PLA, PC, PMMA, POM, PA, ABS, PVDF, PTFE or any combination thereof.

In some embodiments, the adhesive resin layer comprises one or more materials selected from polyester resin, phenolic resin, alkyd resin, polycarbonate resin, polyamide resin, polyurethane resin, silicone resin, epoxy resin, polyethylene resin, acrylic resin, polystyrene resin, polypropylene resin or any combination thereof.

In some embodiments, the frictional material layer comprises aluminum oxide or silica glass.

In some embodiments, the frictional material layer comprises a grit particle size of 80 or less.

In some embodiments, the frictional material layer comprises a grit particle size of 60 or less.

In some embodiments, the frictional material layer comprises a coefficient of friction with a human hand of at least 0.6.

In some embodiments, the frictional material layer comprises a coefficient of friction with a human hand of at least 0.7.

In some embodiments, the flexible polymer base layer comprises a top side and a bottom side, wherein a first adhesive resin layer is disposed on the top side to couple the frictional material layer thereto, and wherein a second adhesive resin layer is disposed on the bottom side to couple the flexible polymer base layer to the outer shell body.

In some embodiments, a shower gripping accessory device is provided comprising an elongate cylindrical body having a plurality of terminal ends, wherein the elongate cylindrical body comprises an outer shell body and a cavity therein, and wherein a thickness value of the outer shell body is substantially between one-quarter to one-half a radius value of the cavity; and a multilayered frictional surface substrate disposed over the outer shell body, wherein the multilayered frictional surface substrate comprises a flexible polymer base layer, one or more adhesive resin layers and a frictional material layer, wherein the one or more adhesive resin layers couple the frictional material layer to the flexible polymer base layer, wherein the frictional material layer comprises aluminum oxide or silica glass, and wherein the flexible polymer base layer comprises a top side and a bottom side, wherein a first adhesive resin layer is disposed on the top side to couple the frictional material layer thereto, and wherein a second adhesive resin layer is disposed on the bottom side to couple the flexible polymer base layer to the outer shell body.

In some embodiments, a shower gripping accessory device is provided comprising an elongate cylindrical body having a plurality of terminal ends, wherein the elongate cylindrical body comprises an outer shell body and a cavity therein, and wherein a thickness value of the outer shell body is substantially between one-quarter to one-half a radius value of the cavity; and a multilayered frictional surface substrate disposed over the outer shell body, wherein the multilayered frictional surface substrate comprises a flexible polymer base layer, one or more adhesive resin layers and a frictional material layer, wherein the one or more adhesive resin layers couple the frictional material layer to the flexible polymer base layer, wherein the frictional material layer comprises aluminum oxide or silica glass, wherein the frictional material layer comprises a grit particle size of 80 or less, wherein the frictional material layer comprises a coefficient of friction with a human hand of at least 0.6, and wherein the flexible polymer base layer comprises a top side and a bottom side, wherein a first adhesive resin layer is disposed on the top side to couple the frictional material layer thereto, and wherein a second adhesive resin layer is disposed on the bottom side to couple the flexible polymer base layer to the outer shell body.

In the preceding and following description, various techniques are described. For purposes of explanation, specific configurations and details are set forth in order to provide a thorough understanding of possible ways of implementing the techniques. However, it will also be apparent that the techniques described below may be practiced in different configurations without the specific details. Furthermore, well-known features may be omitted or simplified to avoid obscuring the techniques being described.

Exemplary embodiments of the present invention are illustrated in the accompanying figures. As shown in FIG. 1, a perspective view of a shower gripping accessory device 100 is portrayed. The device 100 generally comprises an elongate cylindrical body 110 disposed between first and second terminal ends 120 with a frictional surface material 140 disposed along the exterior of the body 110. The body 110 may comprise curvature 130 at any point there along including at the first or second terminal end 120 or any point therebetween. Alternatively, the body 110 may not comprise any curvature 130 at all but rather may be centered along a first axis running through the first and second terminal ends 120. As shown in FIG. 1, the curvature 130 is disposed proximate (though not adjacent) the first and second terminal ends 120.

Further, the body 110 may have any suitable length allowing the shower gripping accessory device 100 to extend between any number of surfaces to which the device 100 is coupled. Accordingly, while FIG. 1 illustrates the body 110 as being centered along the first axis, the body 110 may comprise one or more junctions extending off of the first axis and oriented along a second axis non-parallel with the first axis. For example, the body 110 may extend between two areas of a wall, between a floor and the wall, between two areas of the floor, between the floor and a ceiling and generally between any two or more structurally static surfaces.

Additionally, the body 110 may comprise one or more apertures (not shown) disposed at one or more terminal ends 120 thereof. The apertures may comprise threads therein to be utilized with complementary threaded bolts so that the device 100 may be semi-permanently secured to the two or more structurally static surfaces. Specifically, the apertures may be disposed within flanges extending off of the terminal ends 120 in a manner perpendicular thereto.

The body 110 itself may be made from any robust metal or non-metal material. Specifically, robust metal materials include, but are not limited to, aluminum, titanium, magnesium, steel, steel alloys or other similar materials and any combinations thereof. Robust non-metal materials include, but are not limited to, PET, PE, PVC, PP, PS, PLA, PC, PMMA, POM, PA, ABS, PVDF, PTFE or other similar materials and any combinations thereof. In some embodiments, the body 110 may comprise both robust metals and non-metals at various points there along.

Further, the body 110 may comprise one or more illumination elements (not shown) disposed at any portion there along. Preferably, the one or more illumination elements are disposed proximate the terminal ends 120 or portions of curvature 130 in order to provide a user of the device 100 a visible picture of where the device 100 is physically situated in a poorly illuminated environment, thereby reducing the chances that the user experiences an injurious fall.

Specifically, the one or more illumination elements may take the form light emitting diodes, fluorescent materials, phosphorescent materials or other luminescent materials such as, but not limited to, Zinc Sulfide, Strontium Aluminate or other similar materials and any combinations thereof. The light emitting diodes may be disposed at individual portions of the body 110 or may be disposed along the entirety of the length of the body 110. The luminescent materials may be coated onto specific portions of the body 110 exterior or may be coated along the entirety of the body 110 exterior. Further, the luminescent materials may be impregnated into the one or more robust metal or non-metal materials and/or may be impregnated into the frictional surface material 140 disposed along the exterior of the body 110.

The frictional surface material 140 may take the form of an externally applied material that is not unitary with the body 110 and therefore may be applied over any length portion of the body 110. The material 140 may be multi-layered in nature and may comprise a base layer comprising a flexible polymer material made from materials including PET, PE, PVC, PP, PS, PLA, PC, PMMA, POM, PA, ABS, PVDF, PTFE or other similar materials and any combinations thereof. The base layer comprises a top side and a bottom side. The material 140 may further comprise an adhesive layer disposed upon either or both sides of the base layer, where the adhesive layer may comprise any suitable adhesive material including, but not limited to, polyester resins, phenolic resins, alkyd resins, polycarbonate resins, polyamide resins, polyurethane resins, silicone resins, epoxy resins, polyethylene resins, acrylic resins, polystyrene resins, polypropylene resins or other similar materials and any combinations thereof. The adhesive layer disposed on the bottom side of the base layer may allow the base layer to be adhered to the external surface of the body 110. The adhesive layer disposed on the top side of the base layer may allow for coupling of a layer of high coefficient of friction material to the top side of the base layer.

Further, the layer of high coefficient of friction material disposed over the adhesive layer on the top side of base layer may be made from any suitable high-friction material including, but not limited to, aluminum oxide, silica glass or other similar materials and any combinations thereof. Generally, the high coefficient of friction material may be any material meeting a threshold grit particle size such as, but not limited to, less than 100 grit particle size, but preferably less than 80 grit particle size and most preferably between 60-80 grit particle size. Additionally, the high coefficient of friction material may be any material meeting a threshold coefficient of friction with a human hand such as, but not limited to, at least 0.5, but preferably at least 0.6 and most preferably at least 0.7.

Alternatively, the frictional surface material 140 may take the form of embossed and/or debossed structures formed unitarily into the body 110. The embossed and/or debossed structures may satisfy the threshold grit particle size of less than 100 grit particle size, but preferably less than 80 grit particle size and most preferably between 60-80 grit particle size. Similarly, the embossed and/or debossed structures may satisfy the threshold coefficient of friction with a human hand of at least 0.5, but preferably at least 0.6 and most preferably at least 0.7.

Alternatively, the embossed and/or debossed structures may take the form of individual formations manufactured into the form factor of the body 110. Specifically, the formations may take any suitable shape including, but not limited to, rectangular, cylindrical, spherical, triangular or other similar structures and any combinations thereof. The length, width and height dimensions of the formations may generally be on the micrometer/millimeter scale but preferably are between 100 microns and 2 millimeters, more preferably between 400 microns and 1.5 millimeters and most preferably between 700 microns and 1 millimeter. The pitch and spacing dimensions of the formations may generally be on the micrometer/millimeter scale but preferably are between 100 microns and 2 millimeters, more preferably between 400 microns and 1.5 millimeters and most preferably between 700 microns and 1 millimeter.

Figure 2A:
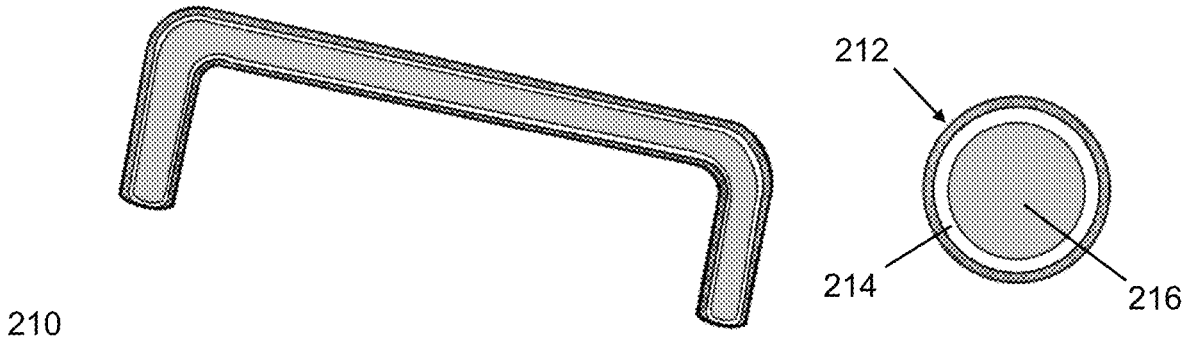
FIG. 2A is a cross-sectional view of the shower gripping accessory device of FIG. 1 in accordance with some embodiments of the present invention.

As shown in FIG. 2A, a cross-sectional view of a shower gripping accessory device 210 having annular shape and in accordance with shower gripping accessory device 100 of FIG. 1 is portrayed. The device 210 comprises a layer of frictional surface material 212 which itself may comprise a multilayered structure comprising a flexible polymer base layer, one or more adhesive layers and a layer of high coefficient of friction material as described with reference to FIG. 1. The device 210 further comprises a layer of body material 214 having an annular cross-section with a cavity 216 disposed therein. Use of the cavity 216 allows for a reduction in material cost and material weight when manufacturing the device 210.

The cross-sectional dimensions of the shower gripping accessory device 210 may be designed to accommodate being gripped by a human hand of a user. Therefore, the cavity 216 may have a radius of between 1-8 centimeters, but preferably between 3-6 centimeters and more preferably between 4-5 centimeters. Further, the layer of body material 214 may have a radius (measured from cavity 216 center to outer surface of body material 214) of between 1.5-10.5 centimeters, but preferably between 3.5-8.5 centimeters and more preferably between 4.5-7.5 centimeters. The layer of frictional surface material 212 applied around the layer of body material 214 may only negligibly contribute to the total cross-sectional radius of the shower gripping accessory device 210.

Figure 2B:
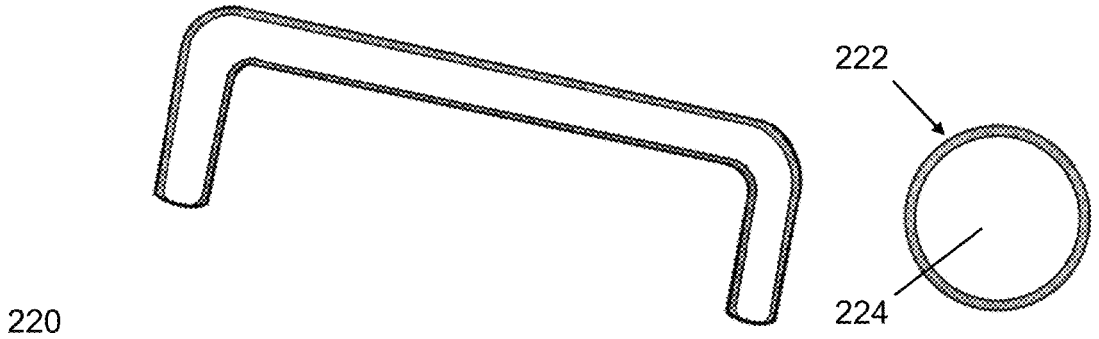
FIG. 2B is a cross-sectional view of a shower gripping accessory device of FIG. 1 in accordance with some embodiments of the present invention.

As shown in FIG. 2B, a cross-sectional view of a shower gripping accessory device 220 having solid cylindrical shape and in accordance with shower gripping accessory device 100 of FIG. 1 is portrayed. The device 220 comprises a layer of frictional surface material 222 which itself may comprise a multilayered structure comprising a flexible polymer base layer, one or more adhesive layers and a layer of high coefficient of friction material as described with reference to FIG. 1. The device 220 further comprises a solid layer of body material 224 having a cylindrical cross-section without a cavity disposed therein. Use of the solid cylindrical layer of body material 224 allows for a robust construction and weighted design of device 220 to be used when larger loads are to be applied to device 220.

The cross-sectional dimensions of the shower gripping accessory device 220 may be designed to accommodate being gripped by a human hand of a user. Therefore, the solid layer of body material 224 may have a radius of between 5-10 centimeters, but preferably between 6-9 centimeters and more preferably between 7-8 centimeters. The layer of frictional surface material 222 applied around the solid layer of body material 224 may only negligibly contribute to the total cross-sectional radius of the shower gripping accessory device 220.

Figure 3:
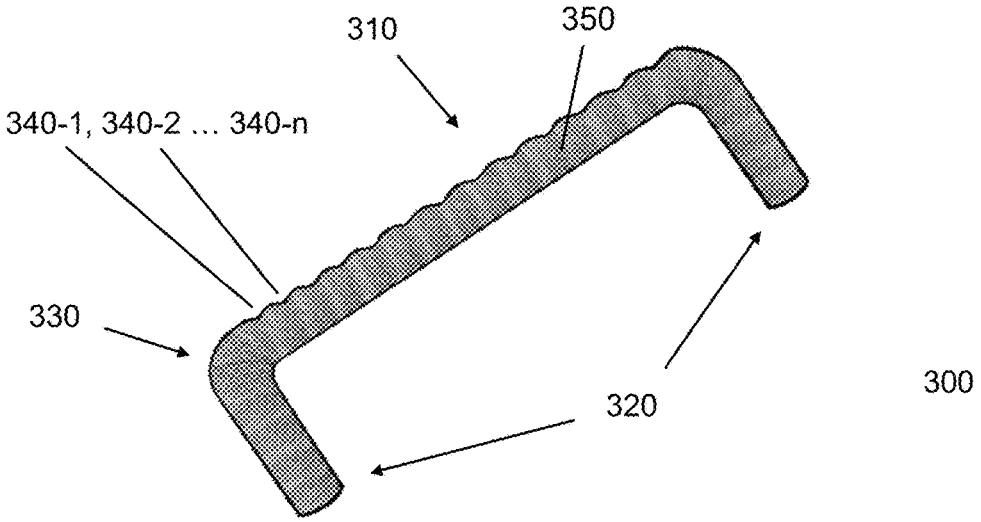
FIG. 3 is a perspective view of a shower gripping accessory device in accordance with some embodiments of the present invention.

As shown in FIG. 3, a perspective view of a shower gripping accessory device 300 is portrayed. The device 300 generally comprises an elongate cylindrical body 310 disposed between first and second terminal ends 320 with a frictional surface material 350 and a plurality of surface structures 340 disposed along the exterior of the body 310. The body 310 may comprise curvature 330 at any point there along including at the first or second terminal end 320 or any point therebetween. Alternatively, the body 310 may not comprise any curvature 330 at all but rather may be centered along a first axis running through the first and second terminal ends 320. As shown in FIG. 3, the curvature 330 is disposed proximate (though not adjacent) the first and second terminal ends 320.

The plurality of surface structures 340 disposed along the body 310 of device 300 may vary in quantity and dimension depending upon the dimensional parameters of the body 310. Therefore, as shown in FIG. 3, the quantity of surface structures 340-1, 340-2 . . . **340-*n* required may be determined by the desired length, pitch and spacing of the arrayed surface structures and also by the desired length of the body 310. Further, the surface structures 340** may take the form of a periodic linear array having surface contour resembling that of, for example, a regular sine wave function, a rectangular sine wave function, a triangular sine wave function or other similar sine wave functions and any combinations thereof.

Generally, the surface contour is characterized by periodic peaks and troughs that resemble embossments and debossments into the outer structure of the elongate cylindrical body 310 of the shower gripping accessory device 300. Such surface contour may be designed to accommodate the shape of fingers of the human hand of the user. Each one of the fingers of user's hand may be placed within the troughs and between the peaks of the surface structures 340 to allow the fingers to maximize the surface area contact with the frictional surface material 350 disposed over each of the surface structures 340 in order to optimize the frictional engagement between the user's hand and the device 300 generally.

Further, the plurality of surface structures 340 may have a pitch and spacing between 1-6 centimeters, but preferably between 1.5-4.5 centimeters and more preferably between 2-3 centimeters. The length, width and/or height dimensions of the plurality of surface structures 340 may be between 1-4 centimeters, but preferably between 2-3 centimeters.

Along the given surface contour of the surface structures 340 is disposed the frictional surface material 350 such that the material 350 covers the entirety of the structures 340 and the body 310. The frictional surface material 350 may take the form of an externally applied material that is not unitary with the body 310 or plurality of surface structures 340. The material 350 may be multilayered in nature and may comprise a base layer comprising a flexible polymer material made from materials including PET, PE, PVC, PP, PS, PLA, PC, PMMA, POM, PA, ABS, PVDF, PTFE or other similar materials and any combinations thereof. The base layer comprises a top side and a bottom side. The material 350 may further comprise an adhesive layer disposed upon either or both sides of the base layer, where the adhesive layer may comprise any suitable adhesive material including, but not limited to, polyester resins, phenolic resins, alkyd resins, polycarbonate resins, polyamide resins, polyurethane resins, silicone resins, epoxy resins, polyethylene resins, acrylic resins, polystyrene resins, polypropylene resins or other similar materials and any combinations thereof. The adhesive layer disposed on the bottom side of the base layer may allow the base layer to be adhered to the external surface of the body 310 and/or plurality of surface structures 340. The adhesive layer disposed on the top side of the base layer may allow for coupling of a layer of high coefficient of friction material to the top side of the base layer.

Further, the layer of high coefficient of friction material disposed over the adhesive layer on the top side of base layer may be made from any suitable high-friction material including, but not limited to, aluminum oxide, silica glass or other similar materials and any combinations thereof. Generally, the high coefficient of friction material may be any material meeting a threshold grit particle size such as, but not limited to, less than 100 grit particle size, but preferably less than 80 grit particle size and most preferably between 60-80 grit particle size. Additionally, the high coefficient of friction material may be any material meeting a threshold coefficient of friction with a human hand such as, but not limited to, at least 0.5, but preferably at least 0.6 and most preferably at least 0.7.

Alternatively, the frictional surface material 350 may take the form of embossed and/or debossed structures formed unitarily into the body 310 and plurality of surface structures 340. The embossed and/or debossed structures may satisfy the threshold grit particle size of less than 100 grit particle size, but preferably less than 80 grit particle size and most preferably between 60-80 grit particle size. Similarly, the embossed and/or debossed structures may satisfy the threshold coefficient of friction with a human hand of at least 0.5, but preferably at least 0.6 and most preferably at least 0.7.

Alternatively, the embossed and/or debossed structures may take the form of individual formations manufactured into the form factor of the body 310 and plurality of surface structures 340. Specifically, the formations may take any suitable shape including, but not limited to, rectangular, cylindrical, spherical, triangular or other similar structures and any combinations thereof. The length, width and height dimensions of the formations may generally be on the micrometer/millimeter scale but preferably are between 100 microns and 2 millimeters, more preferably between 400 microns and 1.5 millimeters and most preferably between 700 microns and 1 millimeter. The pitch and spacing dimensions of the formations may generally be on the micrometer/millimeter scale but preferably are between 100 microns and 2 millimeters, more preferably between 400 microns and 1.5 millimeters and most preferably between 700 microns and 1 millimeter.

Figure 4A:
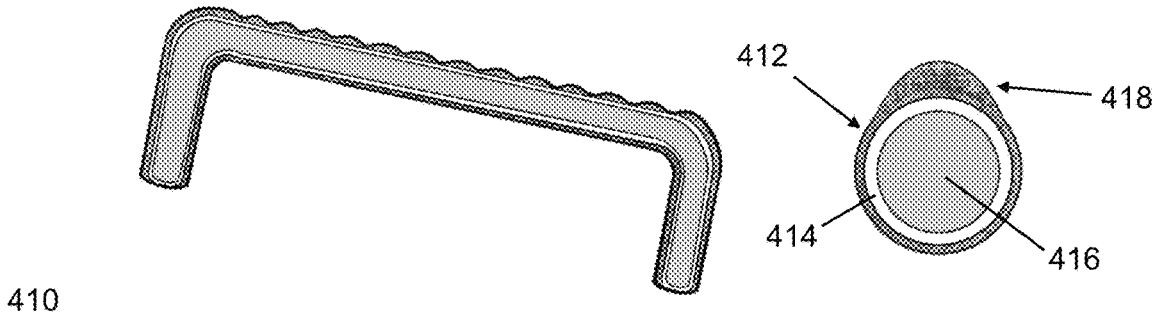
FIG. 4A is a cross-sectional view of the shower gripping accessory device of FIG. 3 in accordance with some embodiments of the present invention.

As shown in FIG. 4A, a cross-sectional view of a shower gripping accessory device 410 having, in part, annular shape and in accordance with shower gripping accessory device 300 of FIG. 3 is portrayed. The device 410 comprises a layer of frictional surface material 412 which itself may comprise a multilayered structure comprising a flexible polymer base layer, one or more adhesive layers and a layer of high coefficient of friction material as described with reference to FIG. 3. The device 410 further comprises a layer of body material 414 having an annular cross-section with a cavity 416 disposed therein. Use of the cavity 416 allows for a reduction in material cost and material weight when manufacturing the device 410. Further, the layer of body material 414 is shown in FIG. 4A to extend upwards into a peak 418 of one of the plurality of surface structures 340 as described in FIG. 3. The peak 418 is shown in FIG. 4A to have the layer of frictional surface material 412 disposed along the surface contour of the peak 418 and associated trough (not shown) of the surface structures 340 as described in FIG. 3.

The cross-sectional dimensions of the shower gripping accessory device 410 may be designed to accommodate being gripped by a human hand of a user. Therefore, the cavity 416 may have a radius of between 1-8 centimeters, but preferably between 3-6 centimeters and more preferably between 4-5 centimeters. Further, the layer of body material 414 may have a radius (measured from cavity 416 center to outer surface of body material 414) of between 1.5-10.5 centimeters, but preferably between 3.5-8.5 centimeters and more preferably between 4.5-7.5 centimeters. The layer of frictional surface material 412 applied around the layer of body material 414 and peak 418 may only negligibly contribute to the total cross-sectional radius of the shower gripping accessory device 410.

Figure 4B:
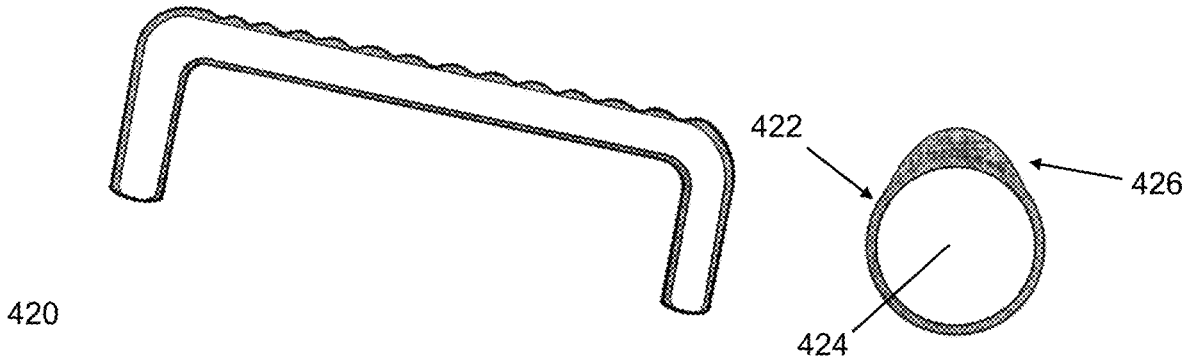
FIG. 4B is a cross-sectional view of the shower gripping accessory device of FIG. 3 in accordance with some embodiments of the present invention.

As shown in FIG. 4B, a cross-sectional view of a shower gripping accessory device 420 having solid cylindrical shape and in accordance with shower gripping accessory device 300 of FIG. 3 is portrayed. The device 420 comprises a layer of frictional surface material 422 which itself may comprise a multilayered structure comprising a flexible polymer base layer, one or more adhesive layers and a layer of high coefficient of friction material as described with reference to FIG. 3. The device 420 further comprises a solid layer of body material 424 having a cylindrical cross-section without a cavity disposed therein. Use of the solid cylindrical layer of body material 424 allows for a robust construction and weighted design of device 420 to be used when larger loads are to be applied to device 420. Further, the layer of body material 424 is shown in FIG. 4B to extend upwards into a peak 426 of one of the plurality of surface structures 340 as described in FIG. 3. The peak 426 is shown in FIG. 4B to have the layer of frictional surface material 422 disposed along the surface contour of the peak 426 and associated trough (not shown) of the surface structures 340 as described in FIG. 3.

The cross-sectional dimensions of the shower gripping accessory device 420 may be designed to accommodate being gripped by a human hand of a user. Therefore, the solid layer of body material 424 may have a radius of between 5-10 centimeters, but preferably between 6-9 centimeters and more preferably between 7-8 centimeters. The layer of frictional surface material 422 applied around the solid layer of body material 424 and peak 426 may only negligibly contribute to the total cross-sectional radius of the shower gripping accessory device 420.

Generally, the aforementioned embodiments of the shower gripping accessory device may be used in any suitable environment including, but not limited to, bathtubs, urinals, showers, pools, hot tubs, rehab facilities, nursing homes, assisted living facilities, hospitals, saunas, steam rooms, gyms, restaurants, public transportation including trains, airplanes, buses, subways etc., public bathroom stalls, ADA ramps/walkways, handicapped bathrooms, schools, colleges/universities, churches, sports arenas, stadiums, grocery stores, casinos, spas, car dealerships, cruise ships, boats, doctor's offices, veterinarians, hotels, motels, high rises, clubs and the like.

The specification and drawings are to be regarded in an illustrative rather than a restrictive sense. However, it will be evident that various modifications and changes may be made thereunto without departing from the broader spirit and scope of the invention as set forth in the claims. Other variations are within the spirit of the present disclosure. Thus, while the disclosed techniques are susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a," "an," "the," and similar referents in the context of describing the disclosed embodiments (especially in the context of the following claims) are to be construed to cover both the singular and the plural, unless otherwise indicated or clearly contradicted by context. The terms "comprising," "having," "including," and "containing" are to be construed as open-ended terms (i.e., meaning "including, but not limited to,") unless otherwise noted. The term "connected," where unmodified and referring to physical connections, is to be construed as partly or wholly contained within, attached to, or joined together, even if there is something intervening. Recitation of ranges of values are merely intended to serve as a shorthand method of referring individually to each separate value falling within the range, unless otherwise indicated and each separate value is incorporated into the specification as if it were individually recited. The use of the term "set" (e.g., "a set of items") or "subset" unless otherwise noted or contradicted by context, is to be construed as a nonempty collection comprising one or more members. Further, unless otherwise noted or contradicted by context, the term "subset" of a corresponding set does not necessarily denote a proper subset of the corresponding set, but the subset and the corresponding set may be equal.

Conjunctive language, such as phrases of the form "at least one of A, B, and C," or "at least one of A, B and C," is understood with the context as used in general to present that an item, term, etc., may be either A or B or C, or any nonempty subset of the set of A and B and C, unless specifically stated otherwise or otherwise clearly contradicted by context. For instance, in the illustrative example of a set having three members, the conjunctive phrases "at least one of A, B, and C" and "at least one of A, B and C" refer to any of the following sets: {A}, {B}, {C}, {A, B}, {A, C}, {B, C}, {A, B, C}. Thus, such conjunctive language is not generally intended to imply that certain embodiments require at least one of A, at least one of B and at least one of C each to be present. In addition, unless otherwise noted or contradicted by context, the term "plurality" indicates a state of being plural (e.g., "a plurality of items" indicates multiple items). The number of items in a plurality is at least two, but can be more when so indicated either explicitly or by context.

The use of any examples, or exemplary language (e.g., "such as") provided, is intended merely to better illuminate embodiments of the invention and does not pose a limitation on the scope of the invention unless otherwise claimed. No language in the specification should be construed as indicating any non-claimed element as essential to the practice of the invention.

Embodiments of this disclosure are described, including the best mode known to the inventors for carrying out the invention. Variations of those embodiments may become apparent to those of ordinary skill in the art upon reading the foregoing description. The inventors expect skilled artisans to employ such variations as appropriate and the inventors intend for embodiments of the present disclosure to be practiced otherwise than as specifically described. Accordingly, the scope of the present disclosure includes all modifications and equivalents of the subject matter recited in the claims appended hereto as permitted by applicable law. Moreover, although above-described elements may be described in the context of certain embodiments of the specification, unless stated otherwise or otherwise clear from context, these elements are not mutually exclusive to only those embodiments in which they are described; any combination of the above-described elements in all possible variations thereof is encompassed by the scope of the present disclosure unless otherwise indicated or otherwise clearly contradicted by context.

All references, including publications, patent applications, and patents, cited are hereby incorporated by reference to the same extent as if each reference were individually and specifically indicated to be incorporated by reference and were set forth in its entirety.

The invention claimed is:

1. A shower gripping accessory device, comprising:

an elongate cylindrical body having a plurality of terminal ends, wherein the elongate cylindrical body comprises an outer shell body and a cavity therein, and wherein a thickness value of the outer shell body is substantially between one-quarter to one-half a radius value of the cavity; and a multilayered frictional surface substrate disposed over the outer shell body, wherein the multilayered frictional surface substrate comprises a flexible polymer base layer, one or more adhesive resin layers and a frictional material layer, wherein the elongate cylindrical body and the multilayered frictional surface substrate collectively comprise one or more illumination elements disposed in at least one quadrant along the length of the elongate cylindrical body and the multilayered frictional surface substrate, and wherein the one or more adhesive resin layers couple the frictional material layer to the flexible polymer base layer.

2. The shower gripping accessory device of claim 1, wherein the elongate cylindrical body comprises one or more areas of structural curvature.

3. The shower gripping accessory device of claim 1, wherein the elongate cylindrical body and the plurality of terminal ends are disposed along a first common axis.

4. The shower gripping accessory device of claim 1, wherein the elongate cylindrical body comprises one or more elongate portions arranged substantially perpendicular to the elongate cylindrical body at one or more structural junctions thereof, wherein the one or more structural junctions are not disposed adjacent any one of the plurality of terminal ends.

5. The shower gripping accessory device of claim 1, wherein the flexible polymer base layer comprises one or more materials selected from PET, PE, PVC, PP, PS, PLA, PC, PMMA, POM, PA, ABS, PVDF, PTFE or any combination thereof.

6. The shower gripping accessory device of claim 1, wherein the adhesive resin layer comprises one or more materials selected from polyester resin, phenolic resin, alkyd resin, polycarbonate resin, polyamide resin, polyurethane resin, silicone resin, epoxy resin, polyethylene resin, acrylic resin, polystyrene resin, polypropylene resin or any combination thereof.

7. The shower gripping accessory device of claim 1, wherein the frictional material layer comprises aluminum oxide or silica glass.

8. The shower gripping accessory device of claim 7, wherein the frictional material layer comprises a grit particle size of 80 or less.

9. The shower gripping accessory device of claim 7, wherein the frictional material layer comprises a grit particle size of 60 or less.

10. The shower gripping accessory device of claim 7, wherein the frictional material layer comprises a coefficient of friction with a human hand of at least 0.6.

11. The shower gripping accessory device of claim 7, wherein the frictional material layer comprises a coefficient of friction with a human hand of at least 0.7.

12. The shower gripping accessory device of claim 1, wherein the flexible polymer base layer comprises a top side and a bottom side, wherein a first adhesive resin layer is disposed on the top side to couple the frictional material layer thereto, and wherein a second adhesive resin layer is disposed on the bottom side to couple the flexible polymer base layer to the outer shell body.

13. A shower gripping accessory device, comprising:

an elongate cylindrical body having a plurality of terminal ends, wherein the elongate cylindrical body comprises an outer shell body and a cavity therein, and wherein a thickness value of the outer shell body is substantially between one-quarter to one-half a radius value of the cavity; and a multilayered frictional surface substrate disposed over the outer shell body, wherein the multilayered frictional surface substrate comprises a flexible polymer base layer, one or more adhesive resin layers and a frictional material layer, wherein the elongate cylindrical body and the multilayered frictional surface substrate collectively comprise one or more illumination elements disposed in at least one quadrant along the length of the elongate cylindrical body and the multilayered frictional surface substrate, wherein the one or more adhesive resin layers couple the frictional material layer to the flexible polymer base layer, wherein the frictional material layer comprises aluminum oxide or silica glass, and wherein the flexible polymer base layer comprises a top side and a bottom side, wherein a first adhesive resin layer is disposed on the top side to couple the frictional material layer thereto, and wherein a second adhesive resin layer is disposed on the bottom side to couple the flexible polymer base layer to the outer shell body.

14. The shower gripping accessory device of claim 13, wherein the elongate cylindrical body comprises one or more areas of structural curvature.

15. The shower gripping accessory device of claim 13, wherein the elongate cylindrical body and the plurality of terminal ends are disposed along a first common axis.

16. The shower gripping accessory device of claim 13, wherein the frictional material layer comprises a grit particle size of 80 or less.

17. The shower gripping accessory device of claim 13, wherein the frictional material layer comprises a grit particle size of 60 or less.

18. The shower gripping accessory device of claim 13, wherein the frictional material layer comprises a coefficient of friction with a human hand of at least 0.6.

19. The shower gripping accessory device of claim 13, wherein the frictional material layer comprises a coefficient of friction with a human hand of at least 0.7.

20. A shower gripping accessory device, comprising:

an elongate cylindrical body having a plurality of terminal ends, wherein the elongate cylindrical body comprises an outer shell body and a cavity therein, and wherein a thickness value of the outer shell body is substantially between one-quarter to one-half a radius value of the cavity; and a multilayered frictional surface substrate disposed over the outer shell body, wherein the multilayered frictional surface substrate comprises a flexible polymer base layer, one or more adhesive resin layers and a frictional material layer, wherein the elongate cylindrical body and the multilayered frictional surface substrate collectively comprise one or more illumination elements disposed in at least one quadrant along the length of the elongate cylindrical body and the multilayered frictional surface substrate, wherein the one or more adhesive resin layers couple the frictional material layer to the flexible polymer base layer, wherein the frictional material layer comprises aluminum oxide or silica glass, wherein the frictional material layer comprises a grit particle size of 80 or less, wherein the frictional material layer comprises a coefficient of friction with a human hand of at least 0.6, and wherein the flexible polymer base layer comprises a top side and a bottom side, wherein a first adhesive resin layer is disposed on the top side to couple the frictional material layer thereto, and wherein a second adhesive resin layer is disposed on the bottom side to couple the flexible polymer base layer to the outer shell body.

* * * * *